United States Patent [19]

Tyler

[11] 4,446,969

[45] May 8, 1984

[54] REINFORCED NESTABLE CONTAINERS

[75] Inventor: Frank S. Tyler, Wirral, England

[73] Assignee: Lever Brothers Company, New York, N.Y.

[21] Appl. No.: 524,625

[22] Filed: Aug. 19, 1983

Related U.S. Application Data

[63] Continuation of Ser. No. 398,039, Jul. 14, 1982, abandoned, which is a continuation of Ser. No. 190,782, Sep. 25, 1980, abandoned.

[30] Foreign Application Priority Data

Sep. 24, 1979 [GB] United Kingdom ..... 7933000

[51] Int. Cl.[3] ..... B65D 21/02; B65D 1/46

[52] U.S. Cl. ..... 206/519; 220/72; 229/1.5 B

[58] Field of Search ..... 220/72; 229/1.5 B; 206/519, 520

[56] References Cited

U.S. PATENT DOCUMENTS

| | | | |
|---|---|---|---|
| 2,859,557 | 11/1958 | Lattucca | 229/1.5 B |
| 3,123,273 | 3/1964 | Miller | 206/520 |
| 3,397,867 | 8/1968 | Hoff | 229/1.5 B |
| 3,558,001 | 1/1971 | Fritz | 220/72 |
| 3,934,725 | 1/1976 | Edwards | 229/1.5 B |

FOREIGN PATENT DOCUMENTS

| | | | |
|---|---|---|---|
| 1965841 | 7/1971 | Fed. Rep. of Germany | 206/520 |
| 1527548 | 10/1978 | United Kingdom | 229/1.5 B |

*Primary Examiner*—George E. Lowrance

[57] ABSTRACT

Containers, particlarly for food material such as margarine, are provided with fillets between the wall of the cup portion and the pedestal base portion to resist lidding forces. The containers are especially made from plastic film by thermoforming.

6 Claims, 14 Drawing Figures

REINFORCED NESTABLE CONTAINERS

This is a continuation application of Ser. No. 398,039 filed July 14, 1982, which is a continuation of Ser. No. 190,782, filed Sept. 25, 1980 (both now abandoned).

INTRODUCTION

Margarine and like comestibles are commonly marketed in plastic, thin-walled containers of attractive design, from which the contents may be served directly at table. The containers are of a stackable shape for magazine loading in automatic filling operations and usually include provision for retaining closure lids.

The advent of high material costs and the need for economy of limited resources, especially of fossil fuels from which plastics generally originate, has furthered the advantage of lightweight containers. The usual method of manufacture is from sheet plastic material, for example by vacuum- or thermo-forming but thin-walled containers are less resistant to collapse by buckling of the walls under load, for example under lidding pressure. The present invention provides a container with improved resistance in this respect.

PRIOR ART

The provision of stiffening means for thin-walled containers appears in U.S. Pat. No. 3,437,253 which shows a plastic cup mounted on a pedestal base portion and stiffened with ribs which do not however extend outwardly as far as the wall of the cup portion. In particular they do not extend to the base portion to stiffen the corners thereof. This is an important preferred embodiment of the present invention since the corners represent a particular zone of weakness, the plastic material tending during manufacture to flow from these areas.

British Pat. No. 1,356,975 discloses thin-walled nestable containers fitted with internal and external stacking shelves preventing telescopic wedging in tubs of otherwise plain frustroconical shape. Strengthened cups or containers are also disclosed in Belgian Pat. No. 712,158 and French Pat. No. 2,275,144. U.S. Pat. No. 3,441,173 discloses one-piece nestable thin-walled plastic containers having stacking pleat means of double wall thickness cooperable with the circumferentially-extending stacking surface of the container to limit telescoping and hence jamming between nested containers.

General Description of the Invention

This invention relates to containers, particularly but not exclusively to tub-like containers for holding food material such as margarine. Such containers are generally formed with such a configuration that empty containers will fit one within another for storage purposes. This invention is directed particularly but not exclusively to such "nestable" containers.

Containers for margarine and the like are generally formed from a thin walled plastics material. In use, they are first filled with the margarine or other comestible product and then a plastics material lid is fitted. A certain force, referred to herein as the lidding force, is required to apply the lid to the filled container. It would clearly be desirable, both from considerations of cost and weight, to reduce the thickness of the plastics material walls which make up the container. However, when the wall thickness is reduced, the rigidity of the container particularly in a direction perpendicular to the lid, is reduced. The lidding force and transit and storage forces then cause the sides of the container to buckle with the result that the lid may not be properly fitted and/or the comestible material may be forced out of the container.

It is an object of this invention to provide a container in which the rigidity in a direction perpendicular to the lid is improved, thereby enabling the container to be formed of a thinner material.

According to the invention there is provided a container comprising a cup portion, a pedestal base portion and an intermediate portion extending between the cup portion and the pedestal base portion, the cup portion, pedestal base portion and intermediate portion constituting discrete integral parts of the container, strengthening fillets being provided between the wall of the cup portion and the pedestal base portion to resist lidding transport and storage forces.

The strengthening fillets may be diamond shaped projections formed around the container by creases or folds in the material of the intermediate portion and the pedestal base portion wall. Preferably each such diamond shaped fillet includes a fold along one of its diagonals, preferably the longer, which extends substantially vertically from the junction between the cup portion wall and the intermediate portion to the pedestal base wall, preferably to the bottom of the pedestal base wall of the container. A number of projections may be provided in spaced, contiguous or overlapping relationship with each other, in one or more rows providing a stiffening girdle, preferably extending around the container to a depth from $\frac{1}{4}$ to $\frac{1}{2}$, more preferably about $\frac{1}{3}$ of the height of the container.

The container may be formed of plastic ABS, polystyrene, PVC, polypropylene, high density polyethylene, polyester and multi-layer, i.e. laminated, mixtures thereof. The container may be formed by thermoforming and is preferably constructed of sheet material of substantially uniform thickeners. The shape of the fillets is determined by the shaping of the thermoforming cavity, which is achieved by methods known per se. The container may also be made by vacuum forming or injection moulding.

When the container is made by thermoforming, as is preferred, the wall thickness is not precisely the same at all points of the container. If an excess lidding force is applied, the container will buckle at the weakest point, which is likely to be where the wall thickness is a minimum. For a standard shape of thermoformed PVC container weighing 6.6 g and designed to hold 250 g of margarine, a minimum wall thickness of only 0.2 mm is customarily observed.

The invention provides good resistance to collapse of the container by wall buckling due to lidding pressures even without lateral support at lidding stations.

Embodiments of the invention will now be described, purely by way of example, by reference to the accompanying drawings, in which.

Figure 1:
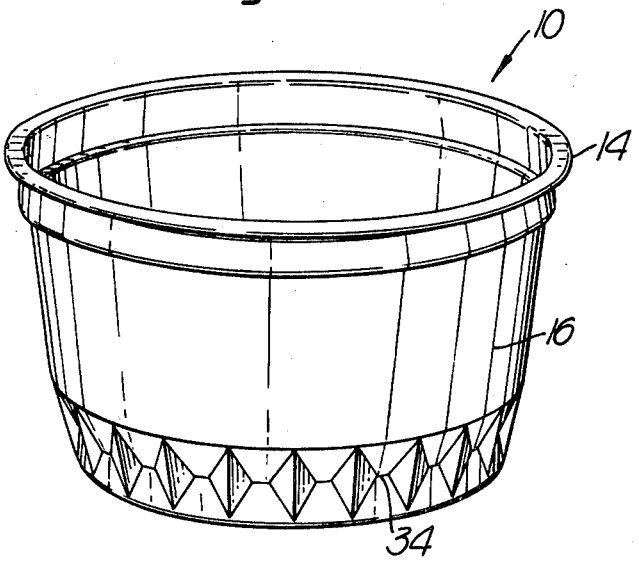
FIG. 1 is a top perspective view from one side of a container according to the invention.
Figure 2:
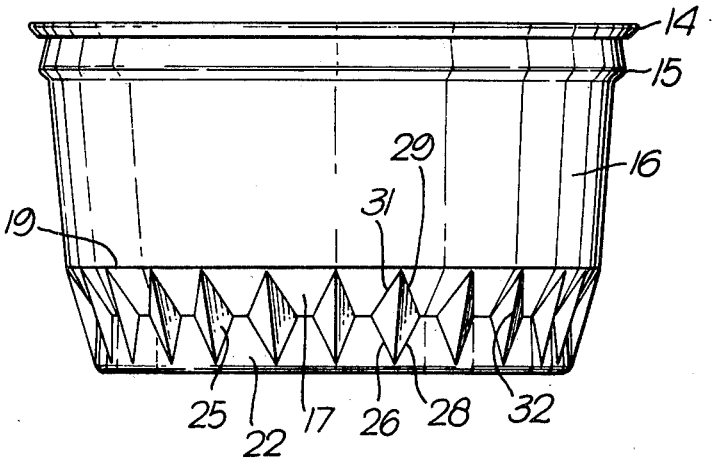
FIG. 2 is a side elevation of the container shown in FIG. 1.
Figure 3:
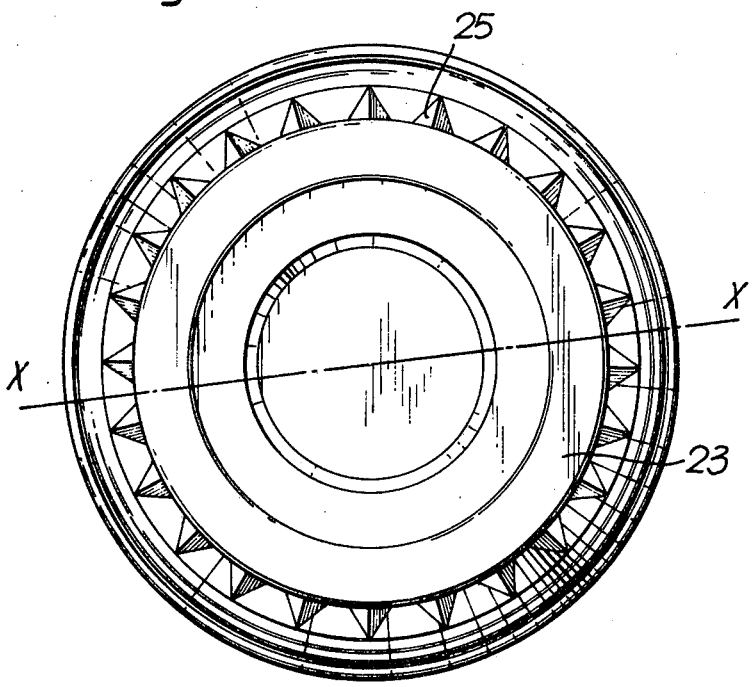
FIG. 3 is an underneath plan view of the container shown in FIGS. 1 and 2.
Figure 4:
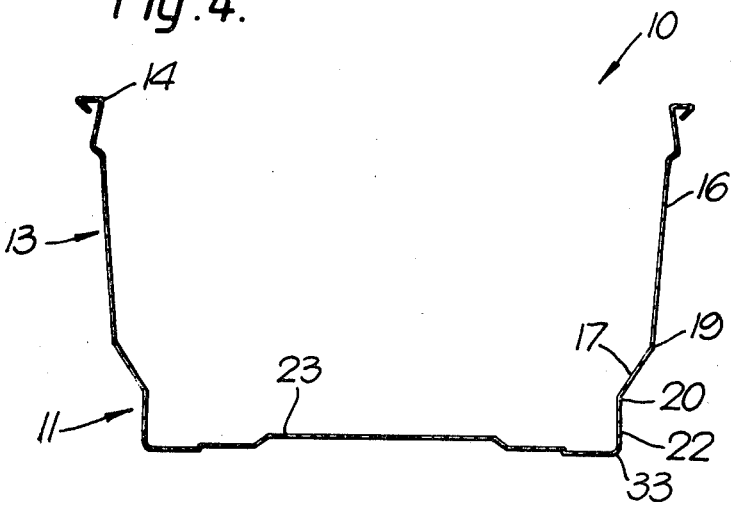
FIG. 4 is a section taken on the line X—X in FIG. 3.

Referring to FIGS. 1 to 4, there is shown a tublike container 10 suitable for margarine. The container includes a hollow pedestal section 11, integral with a cup section 13, all of substantially uniform wall thickness.

The cup section 13 has an upper rim 14 to accommodate a lid (not shown). Below the rim 14 is a de-nesting ridge 15 having an outer diameter greater than the inner diameter of the rim 14, thereby enabling a number of such empty containers to be nested or stacked together without becoming wedged together, i.e. enabling such stacked containers to be easily denested. Below the de-nesting ridge 15, a side wall 16 of the cup portion of the container extends downwardly and approximately vertically, there being a small inward taper in the downward direction which also enables empty containers to be nested. The lower part of the side wall 16 meets a discrete intermediate portion 17 at a corner 19. The intermediate portion 17 extends downwardly with a taper greater than that of the side wall 16 from its junction with the cup to meet with the wall portion.

The lower part of the intermediate portion 17 meets the discrete pedestal portion 11 at a corner 20. The pedestal portion 11 consists of a substantially vertical side wall 22 and a base 23 for the container. The cup portion 13, intermediate portion 17 and the pedestal portion 11 are integral. As shown in FIGS. 1 to 4 the container is rotationally symmetrical about a vertical axis, the diameter of the pedestal portion being clearly less than that of the cup portion.

The container shown in FIGS. 1 to 4 is provided with a number of diamond shaped strengthening fillets 25 folded out from the intermediate portion 17 and the pedestal portion wall 22. Each diamond shaped fillet has first and second relatively short folded edges 26, 28 with the pedestal portion wall 22, third and fourth relatively short folded edges 29, 31 with the intermediate portion and a fifth relatively long substantially vertical fold 32 extending from the corner 19 to the lower part of the pedestal portion wall 22 near where it joins the container bottom wall 23 at the corner 33. The diamond shaped fillets 25 are spaced apart as at 34. In this particular embodiment, twenty-four such equally spaced fillets 25 are provided forming a stiffening girdle around the container.

The diamond shaped fillets 25 and in particular the folds 32 extending substantially vertically from the corner 19 increases the rigidity of the container in the vertical direction. When the lid is fitted a lidding force is applied in a downwards direction to the upper rim 14, the fillets 25 preventing the container from buckling at the weakest points, particularly at the corners 19, 20 and 33.

Figure 5:
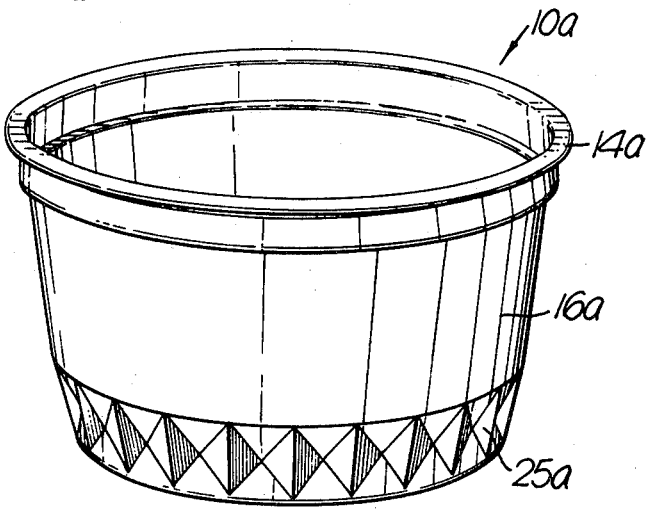
FIG. 5 is a top perspective view from one side of an alternative container according to the invention.
Figure 6:
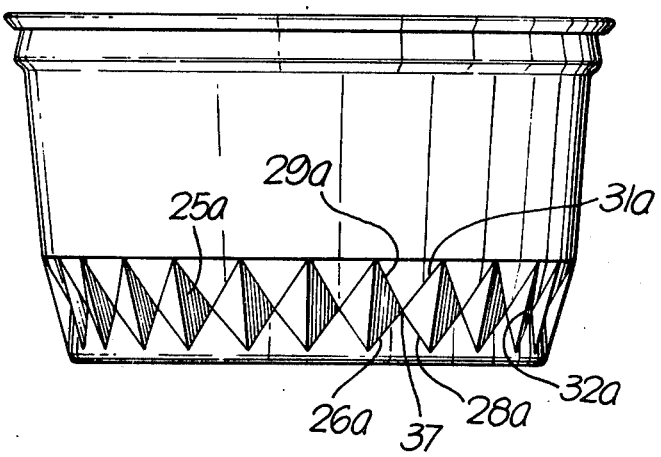
FIG. 6 is a side elevation of the container shown in FIG. 5.

The embodiment shown in FIGS. 5 and 6 is similar to that shown in FIGS. 1 to 4, identical features being indicated by identical reference numbers with the suffix a. This embodiment differs only in that the diamond shaped fillets 25*a* are contiguous with each other, the folds 26*a*, 28*a*, 29*a* and 31*a* meeting at a point 37.

Figure 7:
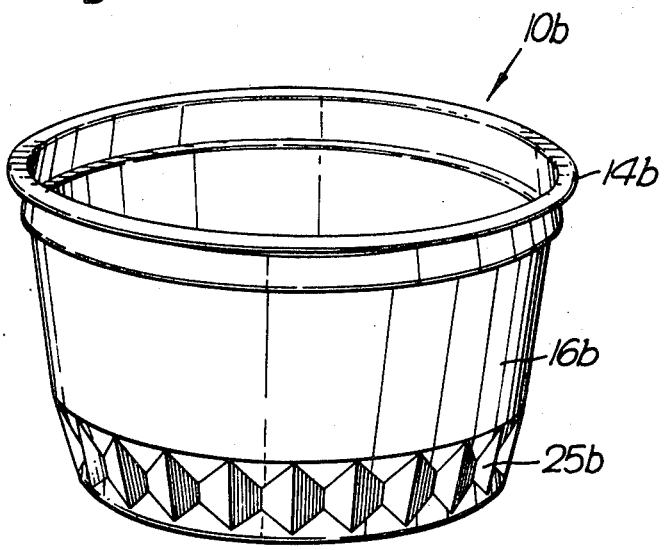
FIG. 7 is a top perspective view from one side of a further alternative container according to the invention.
Figure 8:
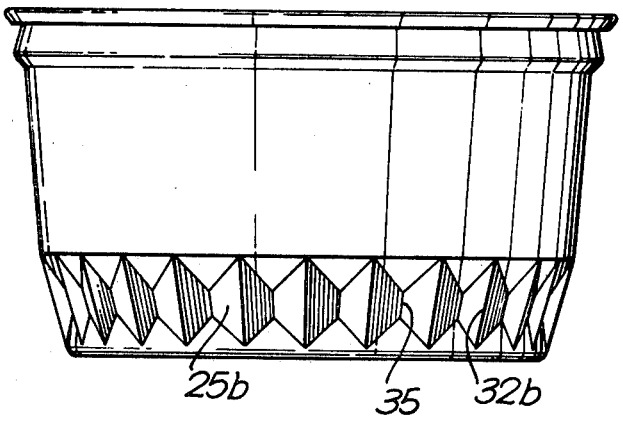
FIG. 8 is a side elevation of the container shown in FIG. 7.

The embodiment shown in FIGS. 7 and 8 is again similar to that shown in FIGS. 1 to 4, identical features being indicated by identical reference numbers with the suffix b. This embodiment differs only in that the diamond shaped fillets 25*b* overlap with each other, thereby forming a number of further substantially vertical folds 35. The advantage of this construction is that the further substantially vertical folds 35 also increase the rigidity of the container in the vertical direction.

Figure 9:
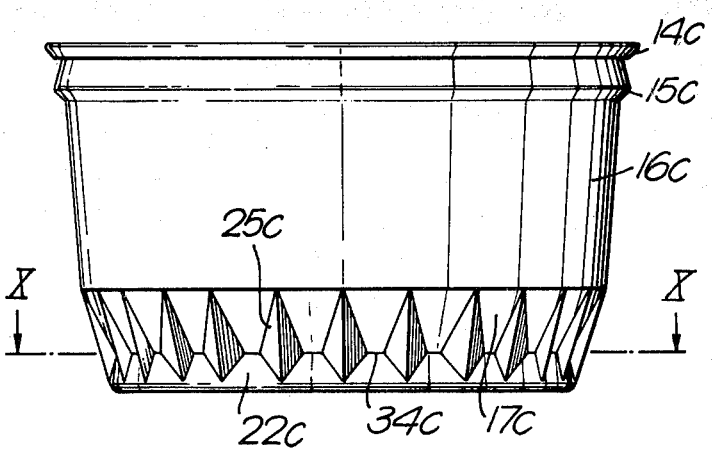
FIG. 9 is a side elevation of a further alternative container according to the invention.
Figure 10:
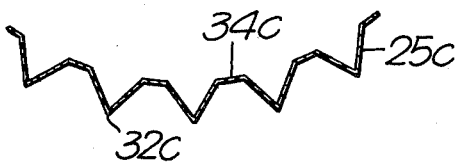
FIG. 10 is an enlarged portion of a section taken on the line X—X in FIG. 9.

Referring to FIGS. 9 and 10, there is shown an embodiment which is similar to that shown in FIGS. 1 to 4, identical features being indicated by identical reference numbers with the suffix c. This embodiment differs in that the pedestal portion wall 22*c* is smaller while the intermediate portion 17*c* is larger. This results in a fillet 25*c* of different shape.

Figure 11:
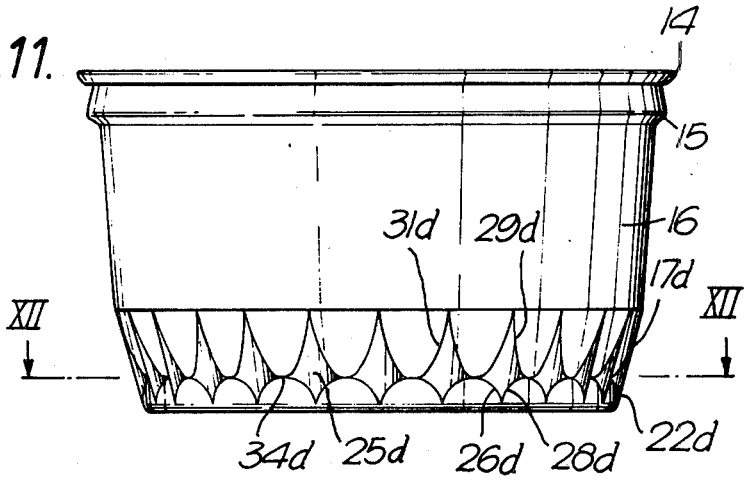
FIG. 11 is a side elevation of a further alternative container according to the invention.
Figure 12:
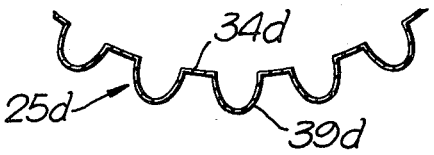
FIG. 12 is an enlarged portion of a section taken on the line XII—XII in FIG. 11.

Referring to FIGS. 11 and 12, there is shown an embodiment which is similar to that shown in FIGS. 1 to 4, identical features being indicated by identical reference numbers with the suffix d. This embodiment differs in that the pedestal wall 22*d* is smaller, the intermediate portion 17*d* is larger and the fillets 25*d* have a curved cross section formed by making the folds 26*d*, 28*d* and 31*d* curved rather than straight. This results in fillets with substantially vertical curved walls 39*d* in place of the substantially vertical folds 32 of the embodiments of FIGS. 1 to 4.

Figure 13:
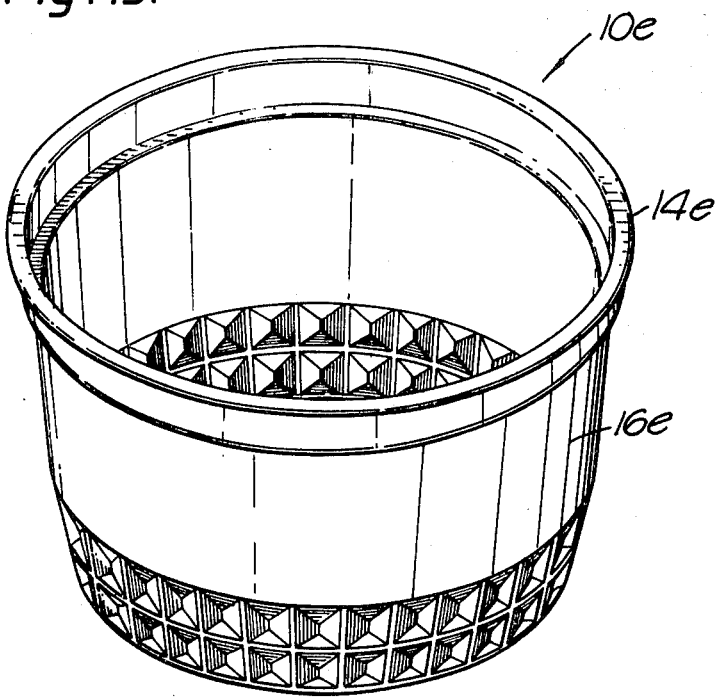
FIG. 13 is a perspective view of a further alternative container according to the invention.
Figure 14:
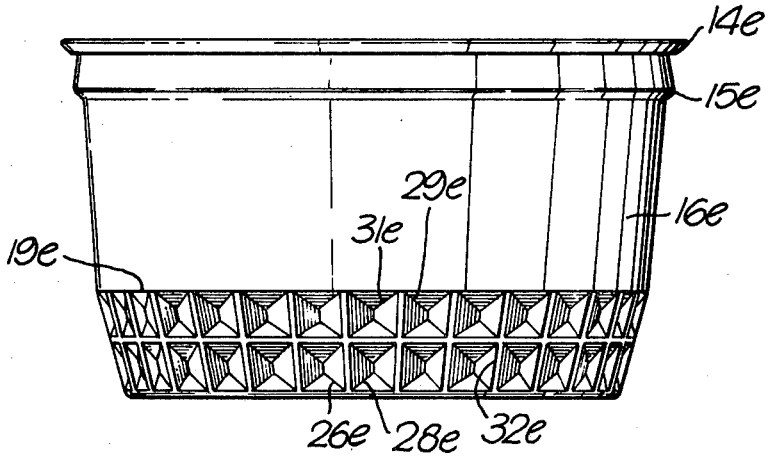
FIG. 14 is a side elevation of the embodiment shown in FIG. 13.

Referring to FIG. 13, there is shown an embodiment similar to that shown in FIGS. 1 to 4, identical features being indicated by the same reference numbers with the suffix e. This embodiment differs in that two superimposed rows of diamond projections are provided.

The invention will be further illustrated by the following Examples.

EXAMPLES 1 to 6

A number of containers, filled with margarine, were subjected to an increasing compressive force in the vertical direction until the walls of the container buckled. The compressive force at this point is the maximum lidding force, F max, to which the container can be subjected. Three designs of container were used. Design A was the embodiment shown in FIGS. 1 to 4. Design B was a standard container comprising side walls and a base wall, but with no pedestal portion or intermediate portion. Design C was the embodiment shown in FIGS. 7 and 8. All containers were made of ABS plastic. The results are shown in the following table. The given values of F max are an average of 30 containers. All containers had a maximum diameter at the mouth of 101 mm, a base diameter of 80 mm and an overall height of 58 mm.

TABLE

| Example | Container Design | Weight of Container | Minimum wall thickness (mm) | F max (kg) |
|---|---|---|---|---|
| 1 | A | 6.7 g | 0.2 | 31.0 |
| 2 | A | 5.6 g | 0.15 | 22.0 |
| 3 | B | 6.7 | 0.2 | 21.5 |

TABLE-continued

| Example | Container Design | Weight of Container | Minimum wall thickness (mm) | F max (kg) |
|---|---|---|---|---|
| 4 | B | 5.6 | 0.15 | 13.5 |
| 5 | C | 6.7 | 0.2 | 33.5 |

It is evident from the Table that substantially increased resistance to lidding pressures is provided by the invention.

What is claimed is:

1. A nestable container of integral construction which is formed from thin-walled plastic material and provides improved resistance to collapse under lidding forces, said container comprising a cup portion having an open upper end and a downwardly tapered sidewall, an intermediate portion having a sidewall which tapers downwardly and inwardly at a greater degree than said tapered sidewall of said cup portion, a pedestal portion having a closed bottom end and a sidewall angled differently from said sidewall of said intermediate portion, said cup portion including a rim at said open upper end and a denesting ridge located below and having a greater diameter than the inner diameter of said rim for denesting like stacked empty containers, and stiffening means bridging said intermediate portion with said pedestal portion for providing collapse-resistance to the container, said stiffening means comprising a circumferentially disposed array of strengthening fillets of substantially diamond shape extending upwardly from said closed bottom end of said pedestal portion to a plane parallel to said closed bottom end of said pedestal portion and intersecting a point where said sidewall of said intermediate portion meets said sidewall of said cup portion, each of said strengthening fillets having a pair of adjoining triangular-like portions inclined relative to one another and which project outwardly from said sidewall of said intermediate portion and said sidewall of said pedestal portion.

2. A container as claimed in claim 1 wherein said fillets are equally spaced from one another circumferentially of said container.

3. A container as claimed in claim 1 wherein said fillets are contiguous with one another circumferentially of said container.

4. A container as claimed in claim 1 wherein said circumferentially disposed array of strengthening fillets includes two rows of said fillets spaced vertically from one another.

5. A container as claimed in claim 1 wherein the vertical extent of said circumferential array of strengthening fillets is in a range of $\frac{1}{4}$ to $\frac{1}{2}$ the height of said container.

6. A container as claimed in claim 1 wherein said container is a thin-walled seamless thermoformed article.

* * * * *